US005376750A

United States Patent [19]

Takeda et al.

[11] Patent Number: 5,376,750

[45] Date of Patent: Dec. 27, 1994

[54] ELECTRONIC MUSICAL INSTRUMENT HAVING WORKING RAM CONTROLLED BY PLURAL CPUS

[75] Inventors: Fumiteru Takeda; Kazuhisa Okamura, both of Hamamatsu, Japan

[73] Assignee: Yamaha Corporation, Hamamatsu, Japan

[21] Appl. No.: 995,577

[22] Filed: Dec. 22, 1992

[30] Foreign Application Priority Data

Dec. 24, 1991 [JP] Japan ..... 3-341548

[51] Int. Cl.[5] ..... G10H 7/00

[52] U.S. Cl. ..... 84/602

[58] Field of Search ..... 84/601, 602, 622–625, 84/645

[56] References Cited

U.S. PATENT DOCUMENTS 4,572,048 2/1986 Franz et al. ..... 84/622

4,644,840 2/1987 Franz et al. ..... 84/645

5,200,564 4/1993 Usami et al. ..... 84/602

FOREIGN PATENT DOCUMENTS 2257198 10/1990 Japan .

*Primary Examiner*—Stanley J. Witkowski

*Attorney, Agent, or Firm*—Spensley Horn Jubas & Lubitz

[57] ABSTRACT

In order to deal with a large amount of data and achieve a high-speed data transfer, an electronic musical instrument employs the configuration providing with plural CPUs and one main memory (RAM) so that the memory is accessed by plural CPUs. Herein, each of the CPUs provides a specific data bus, so that each of them can receive and transfer data via the specific data bus. When performing a data transfer between each CPU and memory, a line connection is selectively established between the memory and selected one of the data buses, so that each CPU can easily perform a data transfer by accessing the memory via its data bus.

10 Claims, 8 Drawing Sheets

(WHOLE CONFIGURATION OF ELECTRONIC MUSICAL INSTRUMENT)

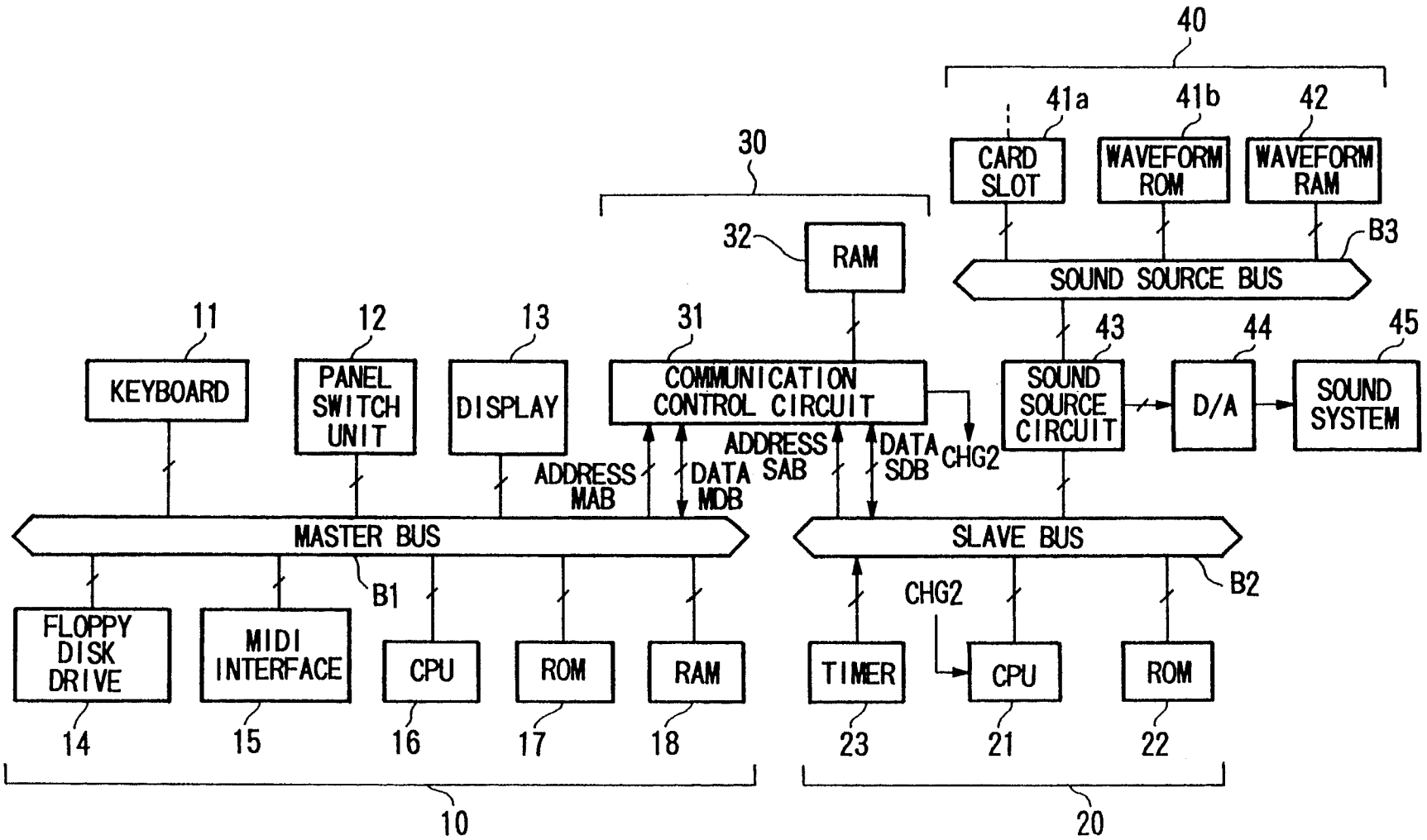
FIG. 1 (WHOLE CONFIGURATION OF ELECTRONIC MUSICAL INSTRUMENT)

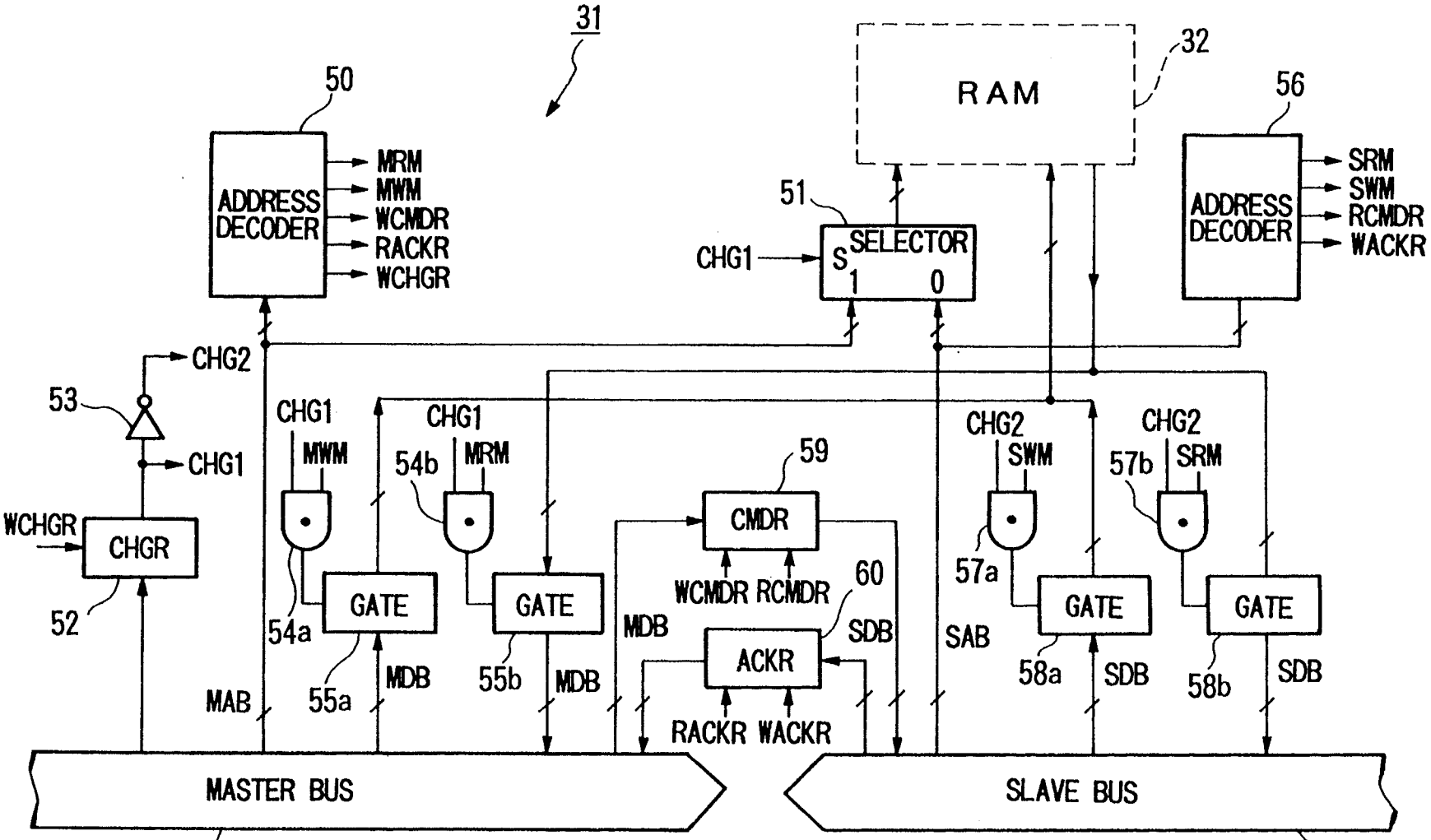
FIG. 2 (DETAILED CONFIGURATION OF COMMUNICATION CONTROL CIRCUIT 31)

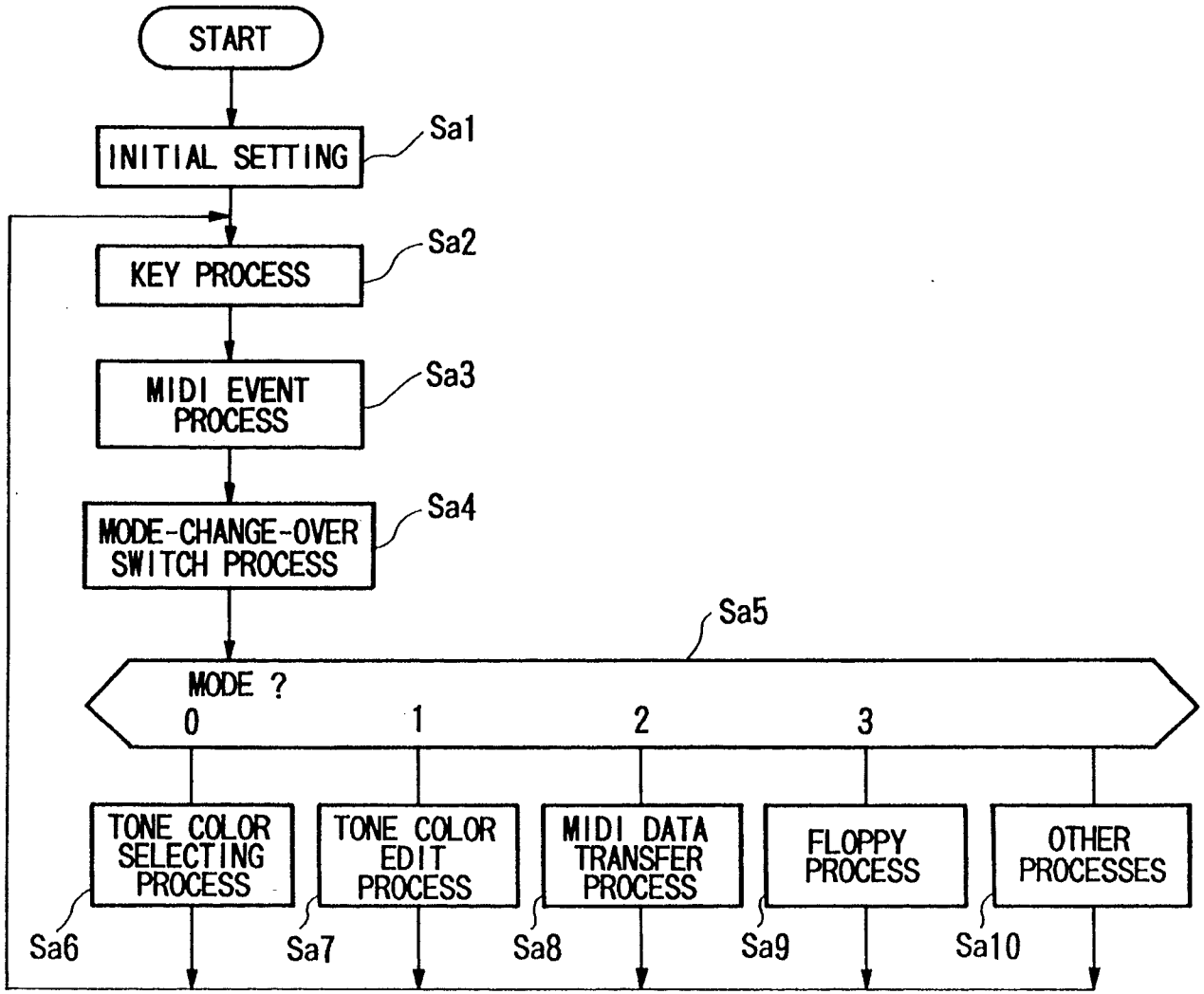
FIG. 3 (MAIN ROUTINE OF CPU 16)

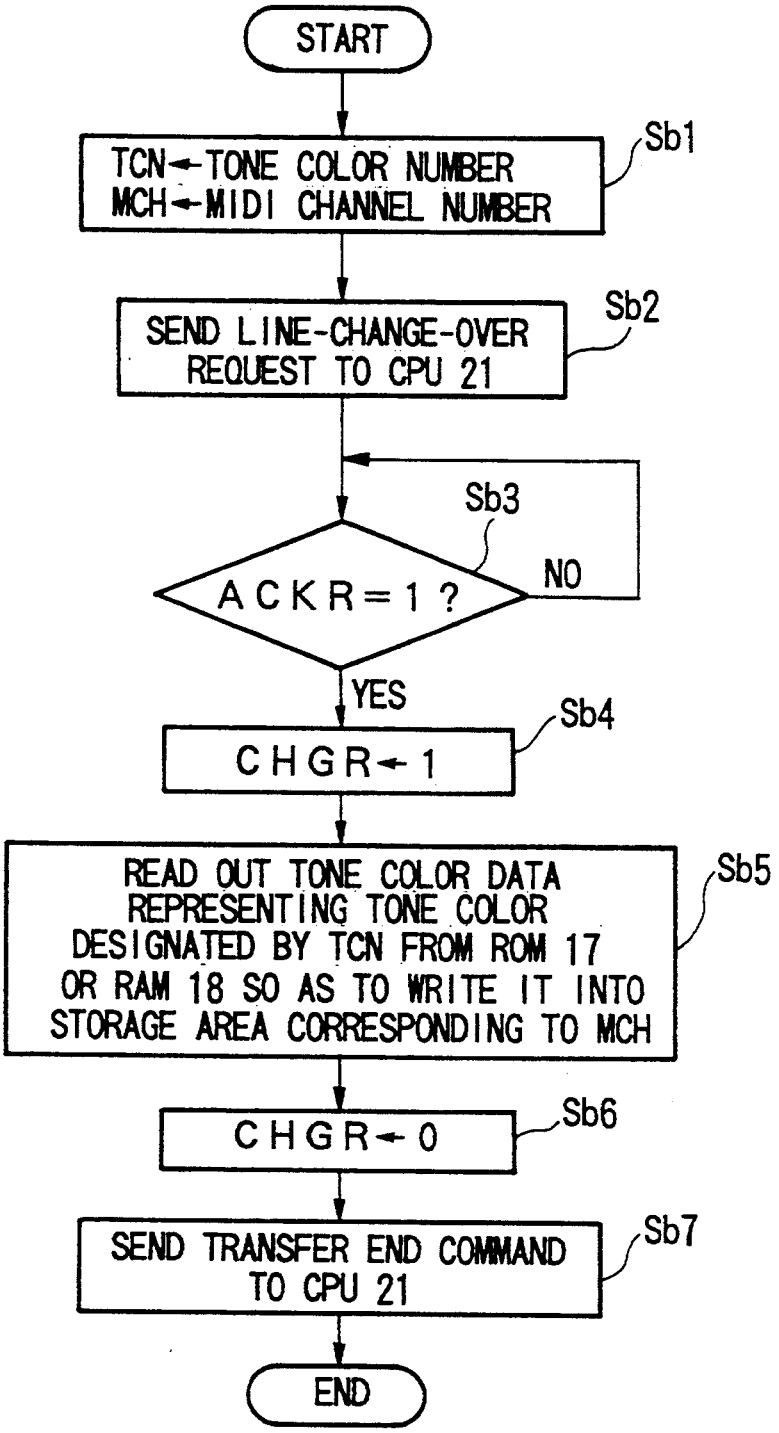
FIG.4 (ROUTINE OF TONE COLOR SELECTING PROCESS)

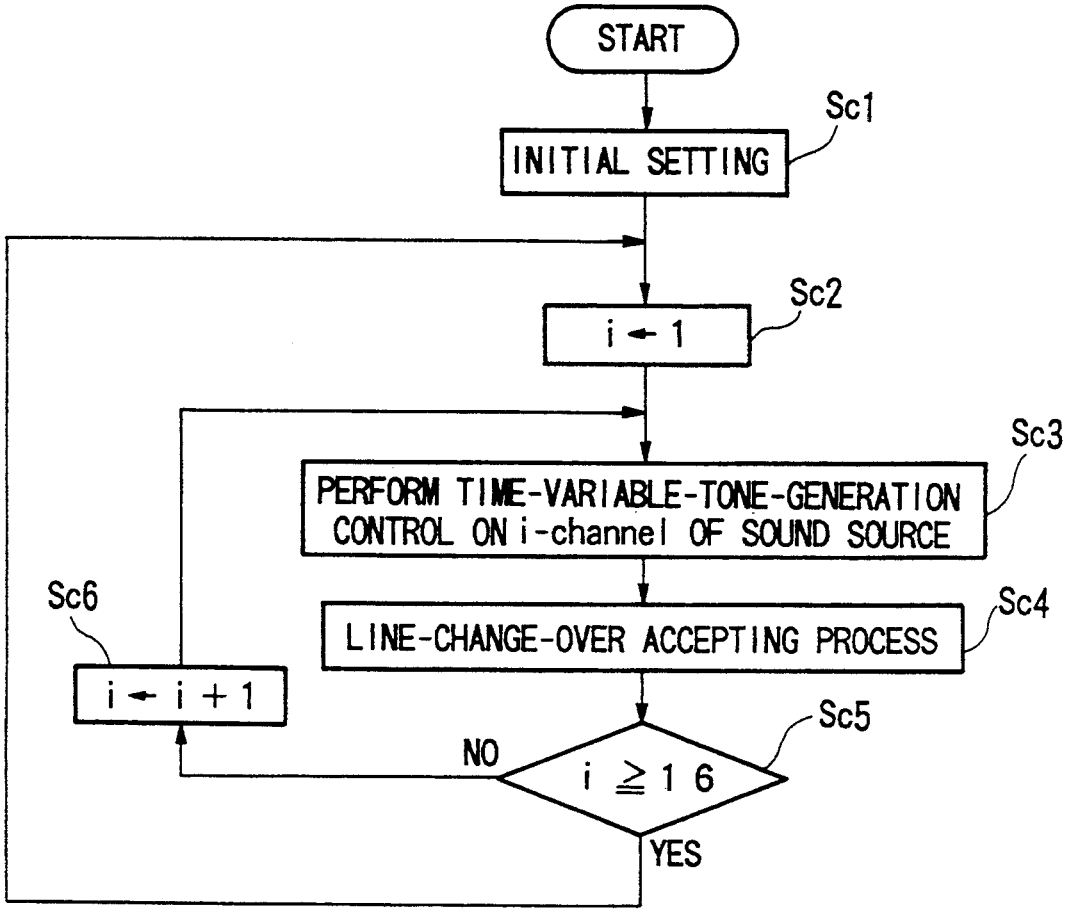
FIG.5 (MAIN ROUTINE OF CPU 21)

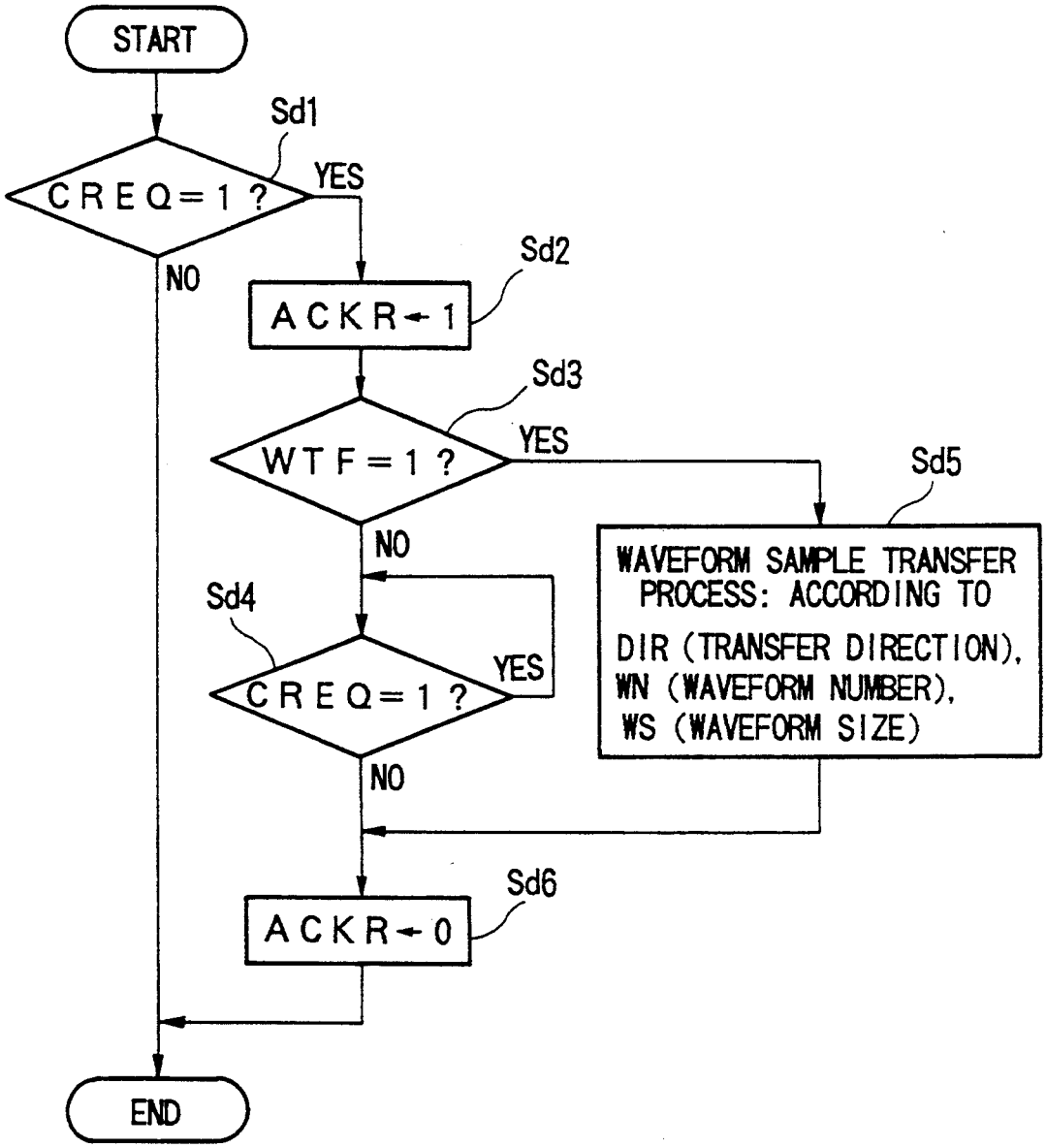
FIG.6 (ROUTINE OF LINE-CHANGE-OVER ACCEPTING PROCESS)

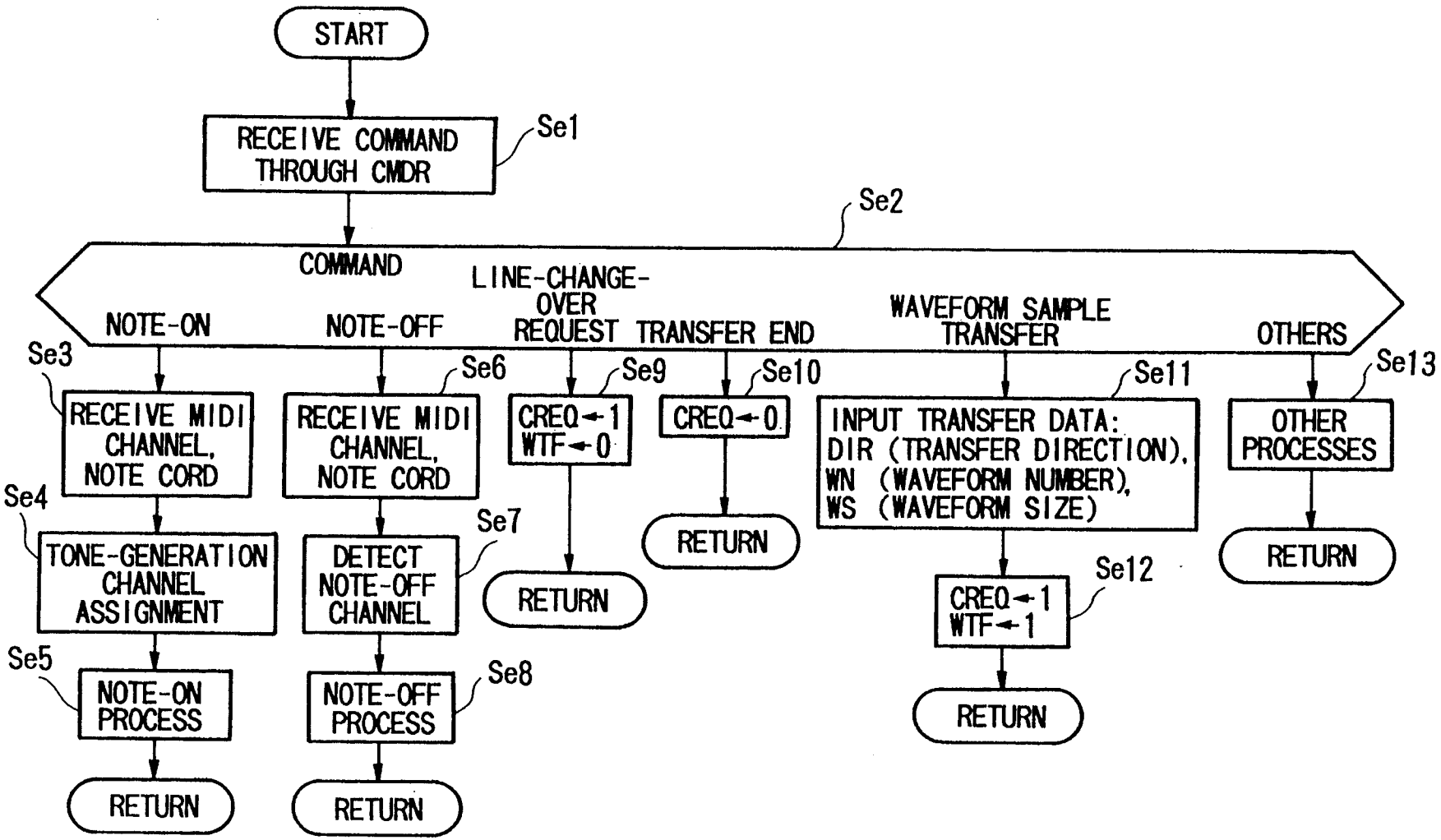
FIG. 7 (ROUTINE OF COMMAND INTERRUPTION PROCESS)

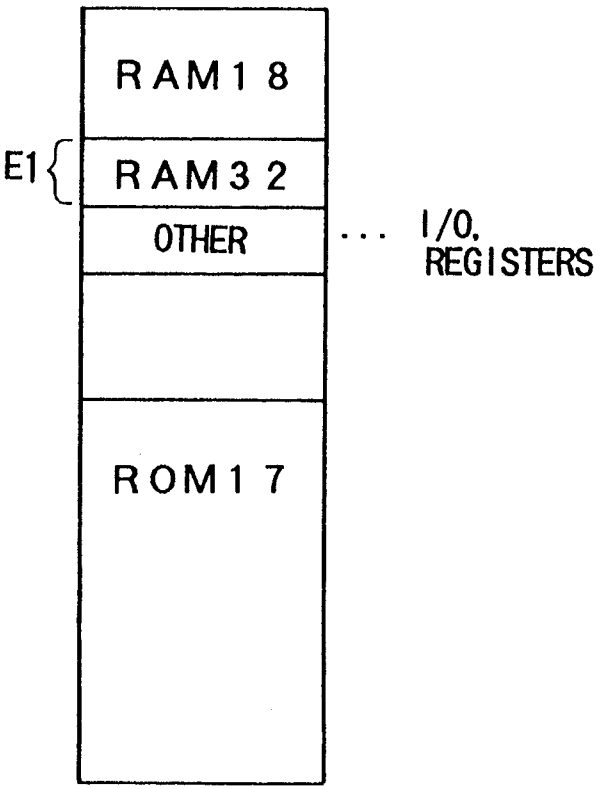
FIG. 8 (ADDRESS MAP OF CPU 16)
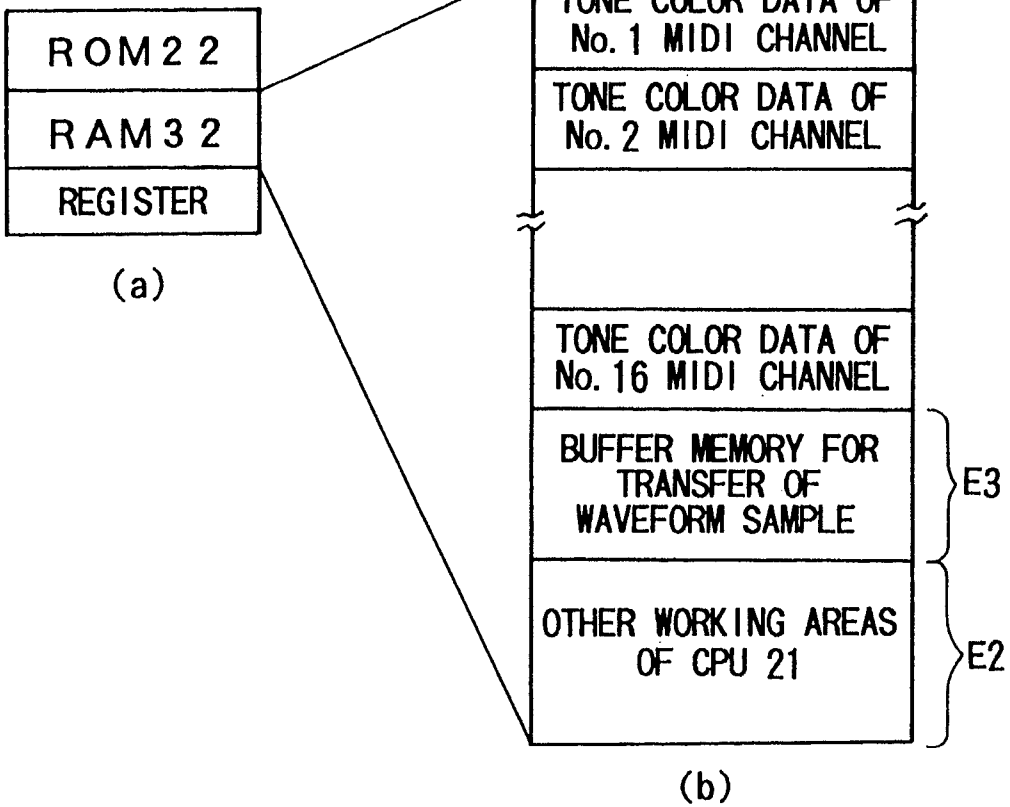
FIG. 9 (ADDRESS MAP OF CPU 21 & MEMORY MAP OF RAM 32)

ELECTRONIC MUSICAL INSTRUMENT HAVING WORKING RAM CONTROLLED BY PLURAL CPUS

BACKGROUND OF THE INVENTION

1. Field of the Invention

The present invention relates to an electronic musical instrument, such as the electronic piano, which performs musical tone processings by use of one or more digital-signal processing units.

2. Prior Art

Some of the well-known electronic musical instruments (e.g., electronic piano) perform several kinds of interrupting operations and processes such as the key-scan operation for the detection of the depressed key, control operation of the sound source circuit for the generation of the musical tone signal responsive to the key-depression Information, and tone-generation assigning processes. Particularly, some of the recently developed electronic musical instruments must deal with a considerable amount of information as tile number of their additional functions are increased, so that a high-speed processing must be required. In order to embody such demand, the electronic musical instrument is developed such that a large amount of information can be processed at a high speed by the provision of plural processing units.

Such kind of electronic musical instrument provides two central processing units (i.e., CPUs) and a time-division control unit, for example. Herein, the first CPU performs the detecting operation for the depressed keys and the switching operations made on several kinds of panel switches, while the second CPU controls the sound source circuit so as to synthesize the musical tones on the basis of the data supplied from the first CPU. The time-division control unit performs a switching operation on the first and second CPUs at tile predetermined timings. Such electronic musical instrument is designed such that one of two CPUs occupies the data bus.

According to the above-mentioned configuration, the processing functions are shared by two CPUs. For this reason, it is possible to improve the processing speed of the instrument as a whole, and it is also possible to raise the performability of the instrument. This kind of electronic musical instrument is disclosed in Japanese Patent Laid-Open Publication No. 2-257198. Incidentally, it is possible to modify the above-mentioned electronic musical instrument, providing plural CPUs, such that the CPUs each connected with the individual data bus can perform the data transmission via the parallel input-/output port.

As described above, the conventional electronic musical instrument provides plural CPUs and performs the time-division control so that one of plural CPUs occupies the data bus. In such configuration, when one CPU occupies the data bus, the other CPU must be in a standby state. In other words, both of the CPUs cannot use the data bus simultaneously, with the result that the usage efficiency of the CPUs cannot be increased. In the modified example of the conventional electronic musical instrument in which the CPUs each having a specific data bus perform the data transmission via the parallel input/output port, there occurs another drawback in that the data transmission speed must be limited and the data sharing cannot be achieved.

SUMMARY OF THE INVENTION

Accordingly, it is an object of the present invention to provide an electronic musical instrument which can achieve the high-speed data transmission and data sharing among plural CPUs.

In order to achieve the above-mentioned object, the electronic musical instrument provides at least two processing units, wherein a first processing unit is designed to generate the musical tone information corresponding to the performance made by the performer, while a second processing unit is designed to control the sound source in response to the musical tone information. There is also provided a selecting unit, intervening between the first and second processing units, which performs a switching operation in response to the data transmission between them so as to select one of the first and second processing units. Further, a memory unit is accessed by the selected processing unit. Herein, each of two processing units can be provided with its own data bus, while one memory unit can be commonly shared by two processing units.

BRIEF DESCRIPTION OF THE DRAWINGS

Further objects and advantages of the present invention will be apparent from the following description, reference being had to the accompanying drawings wherein the preferred embodiment of the present invention is clearly shown.

In the drawings:

FIG. 1 is a block diagram showing the whole configuration of an electronic musical instrument according to an embodiment of the present invention;

FIG. 2 is a block diagram showing a detailed configuration of a communication control circuit 31 shown in FIG. 1;

FIG. 3 is a flowchart showing a main routine for CPU 16:

FIG. 4 is a flowchart showing a routine of a tone color selecting process for CPU 16;

FIG. 5 is a flowchart showing a main routine for CPU 21:

FIG. 6 is a flowchart showing a routine of a line-change-over accepting process for CPU 21;

FIG. 7 is a flowchart showing a routine of a command interruption process for CPU 21;

FIG. 8 is a drawing showing an address map of CPU 16; and

FIG. 9 shows an address map of CPU 21 and a memory map of RAM 32.

DESCRIPTION OF THE PREFERRED EMBODIMENT

[A] Configuration of Embodiment

Now, description will be given with respect to an embodiment of the present invention by referring to the drawings.

FIG. 1 is a block diagram showing the whole configuration of the electronic musical instrument according to an embodiment of the present invention. Herein, numeral 10 designates a musical tone information creating portion which creates several kinds of information such as key-depression Information containing key-on signals and keycodes, MIDI (i.e., Musical Instruments Digital Interface) information supplied from an external MIDI instrument, and tone color information designating the tone color of the musical tone to be generated.

20 designates a sound source control portion which controls a sound source portion 40 (of which a detailed configuration and operation will be described later) on the basis of several kinds of data (hereinafter, simply referred to as musical tone information) created by the musical tone information creating portion 10. In addition, 30 designates a communication control portion which controls a data transmission (or data communication) between the musical tone information creating portion 10 and sound source control portion 20. Further, the sound source portion 40 synthesizes the musical tone signals in accordance with the musical tone information supplied from the sound source control portion 20, so that the corresponding musical tones are generated.

Next, detailed description will be given with respect to each of the above-mentioned portions.

(1) Musical Tone Information Creating Portion 10

In this portion, as shown In FIG. 1, 11 designates a keyboard, provided with the key-depression detecting circuit and the like (not shown), which generates the key-depression information containing the key-on signal, keycode, etc. corresponding to the depressed key. 12 designates a panel switch unit containing several kinds of panel switches which are arranged on the panel face of the electronic musical instrument. This panel switch unit 12 contains the tone-color designating switches, sound-effect designating switches and the like, for example. This unit produces an output signal from the operated switch. 13 designates a display unit which is configured by the liquid crystal display (i.e., LCD) and the like. 14 designates a floppy disk drive which reads out the waveform sample data from the floppy disk, for example.

Meanwhile, 15 designates a MIDI interface, coupled with the external MIDI instrument (not shown), which receives the MIDI information. 16 designates a CPU which produces the musical tone information on the basis of several kinds of data supplied from a master bus B1. This musical tone information is used to designate the pitch and tone color of the musical tone signal to be generated. Under operation of the CPU 16, this information is supplied via the master bus B1 to the communication control portion 30 in the form of address MAB and data MDB (which will be described later in detail). 17 designates a read-only memory (i.e., ROM) which stores control programs to be loaded by the CPU 16, while 18 designates a random-access memory (i.e., RAM), used as the working area of the memory, which temporarily stores several kinds of operation results and register data.

(2) Sound Source Control Portion 20

The sound source control portion 20 produces envelope waveform information and tone-generation/muting designating information in response to the musical tone information supplied from the communication control portion 30, so that the produced information is supplied to the sound source portion 40. This sound source control portion 20 is configured by a CPU 21, a ROM 22 and a timer 23. Herein, the CPU 21 reads the musical tone information (i.e., address SAB and data SDB) which is supplied thereto from a slave bus B2, so that it performs a tone-generation control for the musical tone to be generated.

Moreover, when receiving a signal CHG2 (which will be described later), the mode of the CPU 21 is changed to the sleep mode in which the operation of the CPU 21 is temporarily stopped. Incidentally, the operations of the CPU 21 will be described later. Meanwhile, the ROM 22 stores the control programs to be loaded by the CPU 21. On the other hand, the timer 23 produces tempo clocks which are used for the automatic performance.

(3) Communication Control Portion 30

The communication control portion 30 is configured by a RAM 32 and a communication control circuit 31 which controls a data communication between the musical tone information creating portion 10 and sound source control portion 20. The RAM 32 is configured by the static RAM with the battery backup, so that it can retain the stored data. This RAM 32 is accessed by both of the CPUs 16 and 21 by means of the communication control circuit 31. The CPU 16, as shown in FIG. 8, contains its own RAM 18 and a storage area E1 for the RAM 32 in the address area thereof. In other words, the specific storage area of the RAM 32 is used as the working area for the CPU 21, while the other storage area is shared by both of the CPUs 16 and 21.

Next, detailed description will be given with respect to the configuration of the communication control circuit 31 by referring to FIG. 2. Herein, 50 designates an address decoder which decodes an address signal MAB from the master bus B1 so as to produce several kinds of address signals. Within the address signals outputted from the address decoder 50, MRM designates a read address for the RAM 32, while MWM designates a write address for the RAM 32. Further, WCMDR, WCHGR designate write addresses for the registers, while RACKR designates a read address for the register.

51 designates a selector which changes over the address signal to be supplied to the RAM 32 in response to a signal CHG1. For example, when the signal CHG1 is at "1" level, the address signal MAB supplied from the master bus B1 is selected. When the signal CHG1 is at "0" level, another address signal SAB supplied from the slave bus B2 is selected. 52 designates a register which writes the signal CHG1 therein in accordance with the address WCHGR. 53 designates an inverter which reverses the output of the register 52 so as to produce the signal CHG2.

54*a*, 54*b* designate AND gates, while 55*a*, 55*b* designate gate circuits which are respectively controlled by the aforementioned AND gates 54*a*, 54*b*. More specifically, when the selector 51 selects the master bus B1 and the write address MWM is produced, the gate circuit 55*a* is operated so that the data MDB is supplied to the RAM 32. On the other hand, when the selector 51 selects the master bus B1 and the read address MRM is produced, the gate circuit 55*b* is operated so that the data MDB read from the RAM 32 is transmitted onto the master bus B1.

56 designates an address decoder which decodes the address signal SAB supplied from the slave bus B2 so as to form several kinds of address signals. Among the address signals outputted from the decoder 56, a signal SRM indicates a read address for the RAM 32, while another signal SWM indicates a write address for the RAM 32. Further, a signal RCMDR, WACKR indicate read addresses for the registers.

57*a*, 57*b* designate AND gates, while 58*a*, 58*b* designate gate circuits which are respectively controlled by the outputs of the aforementioned AND gates 57*a*, 57*b*. More specifically, when the selector 51 selects the slave bus B2 and the write address SWM is produced, the gate circuit 58*a* is operated so that the data SDB is written into the RAM 32. On the other hand, when the selector 51 selects the slave bus B2 and the read address SRM is produced, the gate circuit 58*b* is operated so that the data SDB read from the RAM 32 is transmitted onto the slave bus B2.

Furthermore, 59 designates a register which temporarily stores command data supplied from the master bus B1. This command data indicates the command or instruction which is given from the CPU 16 to the CPU 21. For instance, this command data may contain a data transfer command by which the data transfer is instructed. In response to the foregoing write address WCMDR, the command data outputted from the CPU 16 is written into the register 59. Then, the written data is read out and supplied to the CPU 21 by the read address RCMDR. 60 designates a register which temporarily stores response data supplied from the slave bus B2. In response to the foregoing write address WACKR, the response data outputted from the CPU 21 is written into the register 60. Then, the written data is read out and supplied to the CPU 16 by the read address RACKR.

As described above, the communication control circuit 31 connects the RAM 32 to the master bus B1 in response to the line-change-over request given from the CPU 16, enabling the data transfer from the CPU 16 to the RAM 32. In contrast, when the line-change-over request is not made by the CPU 16, the line connection between the RAM 32 and slave bus B2 remains. If there exists merely a small amount of data which is transferred from the circuit portion corresponding to the CPU 16 (i.e., musical tone information creating portion 10) to another circuit portion corresponding to the CPU 21 (i.e., sound source control portion 20), in other words, if the foregoing musical tone information and command data are transferred from the CPU 16 to the CPU 21, the data transfer is not performed by the intervening RAM 32 but by the intervening register 59.

(4) Sound Source Portion 40

Next, by referring to FIG. 1 again, detailed description will be given with respect to the configuration of the sound source portion 40. In FIG. 1, 41*a* designates a card slot in which a ROM card (not shown) is to be inserted. This ROM card to be inserted into the card slot 41*a* stores the tone color designating information such as the waveform data, for example. 41*b* designates a waveform ROM which, like the above-mentioned ROM card, stores the waveform data, while 42 designates a waveform RAM. This waveform RAM 42 stores the waveform samples of which data are read from the aforementioned R0M card, or it stores the waveform data or MIDI data which is transferred from the musical tone information creating portion 10.

Meanwhile, 43 designates a sound source circuit the configuration of which is designed on the basis of the well-known waveform-memory-read-out system. This sound source circuit 43 produces the musical tone signal on the basis of the musical tone information supplied from the sound source control portion 20. 44 designates a digital-to-analog converter (i.e., D/A converter) which converts the digital musical tone signal into the analog musical tone signal. 45 designates a sound system which performs the filtering operations on the analog output of the D/A converter 44. Due to the filtering operation, noises are canceled from the analog signal, or the sound effect is imparted to the analog signal. Then, the sound system 45 amplifies the filtered signal so as to generate the musical tones from the speakers (not shown).

[B] Operation of Embodiment

Next, detailed description will be given with respect to the operation of the embodiment by referring to FIGS. 3 to 9. The feature of the present embodiment lies in the data transfer which is performed between the musical tone information creating portion 10 and sound source control portion 20 by the intervening communication control portion 30. Therefore, the following description will be given with respect to the operations of the CPU 16 (i.e., musical tone information creating portion 10) and CPU 21 (i.e., sound source control portion 20) respectively by focusing on the data transfer between them.

(1) Operation of CPU 16 (i.e., musical tone information creating portion 10)

(a) Main Routine

First, when the power is applied to the electronic musical instrument, the CPU 16 is loading the control programs stored in the ROM 17 so as to start the processings of the main routine as shown in FIG. 3. Thus, the processing of the CPU 16 proceeds to step Sa1 wherein several kinds of registers are initialized and the initial settings are made responsive to the operated states of the panel switches of the panel switch unit 12. In a next step Sa2, the musical tone information containing the key-on/off signals, keycodes, etc. is created in response to the key-depressing operations made by the performer, and this musical tone information is supplied to the sound source control portion 20 via the communication control circuit 31. In this case, the musical tone information is transmitted onto the master bus B1, passing through the register 59 and then being transferred onto the slave bus B2.

Next, when the processing proceeds to step Sa3, the CPU 16 performs a MIDI event process. This MIDI event process corresponds to the process in which the foregoing MIDI information is supplied to the CPU 16 via the MIDI interface 15. The MIDI information contains note event data representing the note-on/off event, note cord, etc. In this case, the CPU 16 transfers the note event data toward the CPU 21 via the register 59. In a next step Sa4, a mode-change-over switch process is carried out. In this process, one of the operation modes "0" to "4" is set in response to the operated panel switch within the switches of the panel switch unit 12. In step Sa5, the CPU 16 identifies the current operation mode which is set at the current timing, so that the processing will be made in response to the identified operation mode.

Next, the processing of each operation mode will be described as follows.

① Tone Color Selecting Process

When the operation mode "0" is designated, the processing of the CPU 16 branches from step Sa5 to step Sa6 wherein the tone color selecting process is carried out. According to this process, when the tone color is designated with respect to the predetermined MIDI channel, the data of the designated tone color are all transferred to the predetermined storage area of the RAM 32 in accordance with the predetermined procedure which will be described later.

② Tone Color Edit Process

When the operation mode "1" is designated, the processing branches to step Sa7 wherein the tone color edit process is carried out. Herein, the tone color data inputted into the RAM 18 is edited. During the editing process, the CPU 16 searches and determines the tone color data of whose value is varied, so that such tone color data is selectively transferred to the RAM 32. Such editing process can be preferred by the CPU 16 which directly reads or writes the data in the RAM 32, or it can be performed by the CPU 21 which is operated under the instruction given from the CPU 16 via the registers 59, 60. In the latter case, it is not necessary to rewrite the contents of the register 52 or change over the line connection of the RAM, which provides for easier processing.

③ MIDI Data Transfer Process

When the operation mode "2" is designated, the processing branches to step Sa8 wherein a MIDI data transfer process is carried out. In this process, the tone color data or waveform sample data which is subjected to the bulk-damping operation by means of the MIDI interface 15 is first inputted into the RAM 17, and then it is transferred to the RAM 32. Incidentally, the waveform sample data is also transferred to the waveform RAM 42 via the sound source circuit 43 under control of the CPU 21. In contrast, when performing the bulk-damping operation on the waveform sample data, read from the waveform R0M 41 or waveform RAM 42, by means of the MIDI Interface 15, this waveform sample data outputted from the CPU 21 is transferred to the RAM 18 via the CPU 16.

④ Floppy Process/Other Processes

When the operation mode "3" is designated, the processing branches to step Sa9 wherein a floppy process is carried out. This process is similar to the foregoing MIDI data transfer process. Thus, in this process, the waveform data read from the floppy disk is transferred to the RAM 32, for example. On the other hand, when the operation mode is other than the aforementioned modes "0" to "3", the processing branches to step Sa10 wherein the other processes are carried out. According to one example of the other processes, when the waveform sample data and tone color data are mixed up and stored in the ROM card, only the tone color data is extracted from the ROM card and then transferred to the RAM 32 or RAM 18.

Thereafter, when one of the above-mentioned processes (i.e., steps Sa6 to Sa10) is completed, the processing of the CPU 16 is returned again to step Sa2, so that the processes of steps Sa2 to Sa10 are repeatedly performed. Thus, under operation of the CPU 16, the musical tone Information is produced in accordance with the key-depressing operation made by the performer, or the musical tone information is produced on the basis of the MIDI information supplied from the external MIDI instrument. Then, the produced musical tone information is supplied to the CPU 21 via the register 59. Thereafter, when another panel switch is operated, another operation mode is started in accordance with the operated panel switch so that the corresponding data transfer is carried out.

(b) Routine of Tone Color Selecting Process

The following description will be given with respect to an example of the tone color selecting process (i.e., step Sa6) wherein the data transfer operation will be described in detail. As described before, when the performer operates the tone color selecting switch (not shown), the processing of the CPU 16 proceeds to step Sa6 so that the routine of the tone color selecting process, as shown in FIG. 4, is started. In a first step Sb1 of this routine, the tone color number is set in a register TCN, while the MIDI channel number designating the tone color is set in a register MCH. Incidentally, this tone color number indicates the kind of the tone color, and it corresponds to the tone color selecting switch operated by the performer.

In a next step Sb2, the CPU 16 produces a line-change-over request command which is written into the register 59. In a step Sb3, the CPU 16 is set at a standby state until response data ACK is transferred from the CPU 21. More specifically, when a value "1" is written into the register 60, the CPU 16 acknowledges the response data ACK so that the judgement result of step Sb3 becomes "YES". Then, the processing proceeds to step Sb4 wherein the value "1" is written into the register 52. As a result, the communication control circuit 31 connects the line between the RAM 32 and master bus B1, and It also produces the signal CHG2 so that the CPU 21 is set in the sleep mode.

Next, the processing proceeds to step Sb5 wherein among the tone color data stored in the R0M 17 (or RAM 18), the tone color data designated by the tone color number set in the register TCN is read out and then written into the RAM 32 via the master bus B1. The writing operation of this tone color data is carried out in accordance with the address signal MWM. In this case, the address signal MWM designates the storage area (see FIG. 9(*b*)) corresponding to the MIDI channel number the tone color of which has already been selected.

The CPU 16 has an address map as shown in FIG. 8. When transferring the data stored in the ROM 17 (or RAM 18) in bulk, the data is written into the predetermined storage area E1 corresponding to the RAM 32 which is managed as the address area of the CPU 16. Next, when completing the data transfer, the CPU 16 proceeds to processing step Sb6 wherein the value set in the register 52 is reset to "0". Thus, the communication control circuit 31 breaks the line between the RAM 32 and master bus B1 and establishes the line between the RAM 32 and slave bus B2, while the CPU 21 is set in the normal mode. After completing the above-mentioned line-change-over operation, the processing proceeds to step Sb7 wherein a transfer end command is sent to the register 59. Thereafter, the processing returns to the foregoing main routine.

As described above, according to the routine of the tone color selecting process, the CPU 16 sends the transfer request to the CPU 21; when the CPU 21 acknowledges the transfer request, the bus line is changed over to establish the line between the RAM 32 and CPU 16; and then, the data transfer is carried out. Thereafter, when the data transfer is completed, the bus line is changed over again to establish another line between the RAM 32 and CPU 21.

(2) Operation of CPU 21 (i.e., Sound Source Control Portion 20)

(a) Main Routine

As in the case of the CPU 16, when the power is applied to the electronic musical instrument, the CPU 21 is loading the control programs stored in the ROM 22, so that the main routine as shown in FIG. 5 is started. In this main routine, the processing of the CPU 21 proceeds to a first step Sc1 wherein the initial setting is made to initialize the contents of the registers. Then, the processing proceeds to a step Sc2.

In step Sc2, the value "1" is set to a register "*i*" which temporarily stores the line-generation channel number. In a next step Sc3, the tone generation of the tone-generation channel No. 1 is controlled. More specifically, in response to the musical tone information outputted from the musical tone information creating portion 10, the CPU 21 controls the envelope waveform and the like of the musical tone to be generated from the tone-generation channel No. 1. In step Sc4, the CPU 21 performs a line-change-over accepting process in response to the line-change-over request command given from the CPU 16. This line-change-over request command requests use of the RAM 32 by the CPU 16. This command is sent from the CPU 16 in the foregoing step Sb2 (see FIG. 4). Incidentally, the detailed contents of the line-change-over accepting process will be described later.

Next, when the processing proceeds to step Sc5, it is determined whether or not the tone-generation control is completely performed on all of the tone-generation channels (i.e., sixteen channels employed in the present embodiment). If the tone-generation control has been completely performed on all of the tone-generation channels, the judgement result of step Sc5 turns to "YES", so that the processing returns to step Sc2. On the other hand, if the tone-generation has not been completely performed on all of the tone-generation channels, the processing proceeds to step Sc6 wherein the tone-generation channel number set in the register i is incremented by "1". After completing the process of step Sc6, the processing returns to step Sc3. Thus, in the main routine, the tone-generation control is performed on the tone-generation channels sequentially in response to the musical tone information, while the CPU 21 receives and accepts the line-change-over request from the CPU 16. In the present embodiment, the CPU 21 performs the processes of the main routine every time the elements of the sound source (e.g., amplitude, filtering coefficient, pitch, parameter of modulation effect, etc.) are changed in a lapse of time. However, it is possible to modify the present embodiment such that these processes are performed intermittently by the timer interruption and the like.

(b) Routine of Line-Change-Over Accepting Process

When the processing of the CPU 21 proceeds to step Sc4, the routine of a line-change-over accepting process as shown in FIG. 6 is started. In a first step Sd1 of this routine, it is determined whether or not a value of a register CREQ is equal to "1". If the CPU 16 supplies the line-change-over request command to the CPU 21, the value "1" is written into the register CREQ by the interruption process (which will be described later). If the value of this register CREQ is not equal to "1", representing that the CPU 21 does not receive the line-change-over request command, the judgement result of step Sd1 becomes "NO" so that the processing of this routine is terminated and the processing returns back to the main routine (see FIG. 5). On the other hand, when the value "1" is written into the register CREQ, the judgement result becomes "YES" so that the processing proceeds to step Sd2. Incidentally, it Is possible to modify the present embodiment such that a specific interruption line is provided between the CPUs 16 and 21. In this case, in response to the interruption directly made through this line, the CPU 21 can perform the line-change-over accepting process of step Sc4.

In step Sd2, the CPU 21 acknowledges the line-change-over request from the CPU 16, so that the response data ACK is set at "1" and then set in the register 60. In a next step Sd3, it is determined whether or not a value of a register WTF is set at "1". This register WTF is provided in a storage area E2 of the RAM 32 (see FIG. 9(*b*)), and it stores a signal designating the transfer event of the waveform sample data to be transferred to or from the sound source portion 40. Incidentally, this waveform sample data is used for forming the musical tone in the sound source portion 40. Therefore, this data Is supplied from the disk inserted in the disk drive 14, or in some cases, this data is given from the RAM 18 which reads out the waveform samples from the disk and then temporarily stores them. Then, this data is passing through the storage area E3 (which is used as the junction buffer), and transferred to the waveform RAM 42 or RAM card inserted in the card slot 41*a*. Further, it is possible to modify the present system such that the waveform samples stored in the waveform RAM 42 and the like are transferred to and then stored in the disk via the storage area E3.

The data transfer to be made from the CPU 16 to the RAM 32 is performed when the tone color data is written into the storage area corresponding to the channel designated by the register MCH (see step Sb5 of FIG. 4). At this time, prior to the data transfer, the CPU 16 sends the line-change-over request to the register CMDR and then waits for an event in which the CPU 21 detects an event of "CREQ=1" so as to set the value "1" to the register ACKR. When such event has occurred, the line connection is changed over such that the RAM 32 is connected with the CPU 16. Thus, the CPU 16 can write the data in the RAM 32. When completing the writing operation, the line connection is changed, under control of the CPU 16, so that the RAM 32 is connected with the CPU 21. After that, the CPU 16 sends the transfer end command to the register CMDR, so that the CPU 21 can escape from the standby state to await completion of a writing operation in step Sd4.

Meanwhile, when transferring the waveform sample data between the sound source portion 40 and musical tone information creating portion 10, the judgement result of step Sd3 turns to "YES", and consequently, the processing proceeds to step Sd5 wherein the transfer of the waveform sample data is performed. Such transfer process is carried out on the basis of the transfer information representing the data transfer direction DIR, waveform number WN and waveform size WS. Such transfer information is stored at the head address of the storage area E3 of the RAM 32 (see FIG. 9). Herein, the data transfer direction DIR designates one of two data transfer directions, i.e., a first direction by which the waveform sample data is transferred from the musical tone information creating portion 10 (i.e., disk drive 14 or RAM 18) to the sound source portion 40 (i.e., card or waveform RAM 42) or a second direction by which the waveform sample data is transferred from the sound source portion 40 (i.e., card, waveform RAM or waveform ROM) to the musical tone information creating portion 10. In accordance with the data transfer direction DIR, the CPU 16 or CPU 21 alternatively accesses the storage area E3 so that the transfer of the waveform sample data is performed. In this case, the waveform sample data written in the disk is divided into plural blocks of data. For example, when transferring the waveform sample data from the disk to the waveform RAM 42, the CPU 16 reads out first-block data of the waveform sample data and then writes it in the storage area E3. On the other hand, the CPU 21 reads out this first-block data from the storage area E3, and then writes it in the storage area, corresponding to the waveform number WN, in the waveform RAM 42. Next, the CPU 16 writes the second-block data into the storage area E3, while the CPU 21 reads it and then writes it in the next storage area of the waveform RAM 42. Similar operations are made with respect to each block data of the waveform sample data, so that plural blocks of data are sequentially transferred to the waveform RAM 42. Thereafter, when the predetermined amount of the waveform sample data which is designated by the waveform size WS is completely transferred to the waveform RAM 42, the data transfer is terminated. The other data transfer operations are carried out in the above-mentioned manner. Herein, plural blocks of the data are sequentially transferred by using the storage area E3 as the junction buffer. When completing the data transfer, the processing proceeds to step Sd6 wherein the value "0" is set in the register 60 which stores the foregoing response data ACK. By detecting the value of this register 60, the CPU 16 can acknowledge the completion of the data transfer of the waveform sample data which is performed by the CPU 21 in the line-change-over accepting process.

According to the above-mentioned routine of the line-change-over accepting process, when the value "1" is set in the register CREQ, the RAM 32 is utilized by the CPU 16. And, when the value "1" is set in the register WTF, the waveform sample data written in the storage area E3 of the RAM 32 is transferred to the sound source portion 40.

(c) Routine of Command Interruption Process

The CPU 21 is provided to perform several kinds of interruption processes in response to the contents of the command data or musical tone information which is set to the register 59 by the CPU 16. More specifically, when the musical tone information or command data is written into the register 59, the routine of command interruption process as shown in FIG. 8 is started. In this routine, the processing of the CPU 21 proceeds to step Se1 wherein the CPU 21 reads out and interprets the contents of the register 59. In a next step Se2, the processing of the CPU 21 selectively branches to one of some processes on the basis of the interpretation result. Incidentally, the following description is written by referring to the case where the MIDI information is given from the external device as the musical tone information. For this reason, instead of the key-on/off events which occur in the normal key-depression/release operations, the following description uses the note-on/off events corresponding to the MIDI information.

① Note-On Process

When the MIDI information representing the note-on event is written into the register 59, processes of steps Se3 to Se5 are selectively carried out. In this case, the CPU 21 receives the MIDI channel number and note cord which correspond to the note-on event at first. Then, the CPU 21 assigns the tone-generation channel for this note-on event, and supplies the tone-generation start instruction to the sound source portion 40.

② Note-Off Process

When the MIDI information representing the note-off event is written into the register 59, processes of steps Se6 to Se8 are selectively carried out. In this case, the CPU 21 receives the MIDI channel number and note cord which correspond to the note-off event at first. Then, the CPU 21 detects the tone-muting channel corresponding to the note-off event, and supplies the tone-muting instruction to the sound source portion 40.

③ Line-Change-Over Request Command Process

When the line-change-over request command is written into the register 59, the processing branches to step Se9. In step Se9, the value "1" is written into the register CREQ, while the value "0" is written into the register WTF. Thus, the judgement result of the foregoing step Sd1 in the routine of line-change-over accepting process becomes "YES".

④ Transfer End Command Process

When the transfer end command is written into the register 59, the processing branches to step So10. In step S310, the value "0" is written into the register CREQ. Thus, the judgement result of the foregoing step Sd4 becomes "NO".

⑤ Waveform Sample Data Transfer Process

In this case, the processing branches to step Se11 wherein the transfer information representing the data transfer direction DIR, waveform number WN and waveform size WS is extracted from the stored contents of the RAM 32. Further, the value "1" is set in both of the registers CREQ and WTF. Thus, the process of the foregoing step Sd5 is carried out, so that the waveform sample data is transferred to the sound source portion 40.

⑥ Other Processes

According to one example of the other processes, when the command data representing the after-touch operation or pitch-bend operation is written Into the register 59, the processing branches to step Se13 wherein the CPU 21 instructs the sound source portion 40 to perform the musical tone process corresponding to the command data.

According to the above-mentioned command interruption process, when the musical tone information (i.e., MIDI information) or command data outputted from the musical tone information creating portion 10 is supplied to the CPU 21 via the register 59, the CPU 21 performs the tone-generation control or data transfer control on the sound source portion 40. Particularly, when transferring a large amount of data such as the waveform sample data, the data given from the CPU 16 is inputted into the buffer area of the RAM 32 in bulk, and then this data is divided into plural pieces of data, each corresponding to hundreds or thousands of bytes, which are sequentially transferred to the sound source portion 40. Thus, as compared to the conventional data transfer system using the parallel input/output port, the present embodiment can achieve a high-speed data transfer.

As described above, the present embodiment is designed such that in response to the data transfer to be performed between the CPUs 16 and 21, the communication control portion 30 changes over the line connection to selectively connect the RAM 32 with the CPU 16 or 21. Thus, it is possible to transfer a large amount of data by use of a single RAM 32. Further, this RAM 32 can be shared by both of the CPUs 16, 21, so that the data sharing can be achieved.

Moreover, the present embodiment is designed such that the communication control portion 30 performs the line-change-over operation in response to the line-change-over request given from the CPU 16. However, the present invention is not limited to such structure. For example, the line-change-over request can be made by the CPU 21. Or, it is possible to mount another CPU in the communication control portion 30, by which the line-change-over operation is controlled. Further, it is possible to additionally provide the conventional data transfer system using the input/output port to the present embodiment.

Incidentally, the present embodiment is designed to perform the foregoing line-change-over accepting process (see step Sc4) every time the tone-generation control is completed with respect to each of the tone-generation channels. Instead, it is possible to perform the line-change-over accepting process after the tone-generation control is completed with respect to all of the tone-generation channels. Or, it is possible to perform the line-change-over accepting process every time some minor controls within the tone-generation control, such as the envelope waveform control and filter coefficient control, are completed.

Lastly, this invention may be practiced or embodied in still other ways without departing from the spirit or essential character thereof as described heretofore. Therefore, the preferred embodiment described herein is illustrative and not restrictive, the scope of the invention being indicated by the appended claims and all variations which come within the meaning of the claims are intended to be embraced therein.

What is claimed is:

1. An electronic musical instrument comprising:
a first bus;
first processing means, connected to said first bus, for sending data;
a second bus;
second processing means, connected to said second bus, for receiving the data sent by said first processing means;
a selecting means;
a memory connected to said selecting device, said memory being alternatively connected to one or the other of said first and second busses through said selecting device;
wherein when said first processing means sends the data, said first processing means requests an occupation of said memory to said second processing means and the data are then written into said memory; and thereafter, when said first processing means completes a writing operation of data, said second processing means reads out the data from said memory.

2. An electronic musical instrument in accordance with claim 1, further including a sound source, and wherein the data comprises first musical tone information corresponding to a performing operation made by a performer, said second processing means controls the sound source in response to said first musical tone information, said memory stores second musical tone information, said sound source is connected to the memory and produces a musical tone signal based on the second musical tone information under the control of said second processing means, the selecting device stores third musical tone information in said memory from said first processing means when the performing operation is a specific operation, and said sound source produces the musical tone signal in accordance with the third musical tone information.

3. An electronic musical instrument in accordance with claim 1, wherein when said first processing means requests an occupation of said memory to said second processing means, said second processing means send an acknowledgement of usage of said memory to said first processing means.

4. An electronic musical instrument in accordance with claim 1, wherein the first and second processing means comprise first and second CPUs respectively.

5. An electronic musical instrument in accordance with claim 4, wherein the selecting device is responsive to a data transfer between the first CPU and the second CPU to selectively establish a line connection between said memory and said first bus or said second bus.

6. An electronic musical instrument in accordance with claim 4, further including a first register for sending data from the first CPU to the second CPU and a second register for sending data from the second CPU to the first CPU.

7. An electronic musical instrument comprising:
first processing means for transferring data;
second processing means for receiving the data; and
communication mode selecting means for selecting one of first and second communication modes in response to a property of the data to be transferred;
wherein when said first communication mode is selected, said first and second processing means cooperate with each other to perform data communication using a common memory connected to both of said first and second processing means, and when said second communication mode is selected, said first processing means interrupts operation of said second processing means to perform a data transfer.

8. An electronic musical instrument in accordance with claim 7, further including a sound source, and wherein the first processing means creates first musical tone information corresponding to a performing operation made by a performer, the second processing means controls the sound source in response to the first musical tone information, the memory stores second musical tone information, and the sound source is connected to the memory and produces a musical tone signal based on the second musical tone information under control of the second processing means.

9. An electronic musical instrument in accordance with claim 7, wherein the first and second processing means comprise first and second CPUs respectively.

10. An electronic musical instrument in accordance with claim 9, further including a first register for sending data from the first CPU to the second CPU and a second register for sending data from the second CPU to the first CPU.

* * * * *